United States Patent [19]

Okugawa et al.

[11] 4,273,579

[45] Jun. 16, 1981

[54] PROCESS FOR TREATING LIQUID CONTAINING AU-CN COMPOUND

[75] Inventors: Michihide Okugawa; Ryougi Ishii, both of Hyogo, Japan

[73] Assignee: Dainichi-Nippon Cables, Ltd., Hyogo, Japan

[21] Appl. No.: 134,688

[22] Filed: Mar. 27, 1980

[30] Foreign Application Priority Data

Mar. 28, 1979 [JP] Japan ..... 54-37616

[51] Int. Cl.[3] ..... C22B 11/04; C22B 11/08

[52] U.S. Cl. ..... 75/106; 75/108; 75/118 R; 423/29; 423/371

[58] Field of Search ..... 75/118 R, 108, 106; 423/29, 371

[56] References Cited

U.S. PATENT DOCUMENTS

| | | | |
|---|---|---|---|
| 538,951 | 5/1895 | Clark | 423/29 |
| 1,103,346 | 7/1914 | Butters | 75/118 R |
| 1,397,684 | 11/1921 | Hahn | 75/118 R X |
| 2,839,387 | 6/1958 | Burton | 75/105 |
| 3,180,705 | 4/1965 | Freedman | 423/29 |
| 3,321,303 | 5/1967 | Roberts | 75/106 |
| 4,167,240 | 9/1979 | Schaaf | 423/29 X |

*Primary Examiner*—G. Ozaki

*Attorney, Agent, or Firm*—Birch, Stewart, Kolasch & Birch

[57] ABSTRACT

This invention relates to a process for treating a liquid containing an Au-CN compound and optionally an Ag-CN compound to decompose the compound(s) and, at the same time, separate gold and optionally silver from the liquid with ease. When containing the Au-CN compound alone, the liquid is heated at a temperature of at least 170° C. in the presence of at least 0.1 mole of a water-soluble metallic hydroxide per gram atom of the gold in the Au-CN compound. When containing the Au-CN compound and the Ag-CN compound, the liquid is heated at a temperature of at least 170° C. in the presence of a water-soluble metallic hydroxide in a total amount of at least 0.1 mole per gram atom of the gold in the Au-CN compound and at least 0.05 mole per gram atom of the silver in the Ag-CN compound. The compound(s) in the liquid are fully decomposable, and at the same time, gold or both gold and silver can be separated out from the liquid singly as such and recovered with a high recovery rate(s).

6 Claims, 1 Drawing Figure

PROCESS FOR TREATING LIQUID CONTAINING AU-CN COMPOUND

BACKGROUND OF THE INVENTION

This invention relates to a process for treating a liquid containing an Au-CN compound and optionally an Ag-CN compound to decompose the compound(s) and separate gold and optionally silver from the liquid.

When gold and/or silver are contained in industrial effluents, their separation and recovery from the effluents are desired because of an economical reason. Since, however, the gold and/or silver present in industrial effluents are generally in the form of chemically stable cyanides, their separation and recovery are not always accomplished with ease.

With greater attention directed to pollution as a social problem in recent years, more stringent standards have been set for the discharge of industrial effluents containing pollutants. CN-containing waste liquids are also under regulation with increased severity. Accordingly, waste liquids containing Au-CN compounds and/or Ag-CN compounds must be treated for the decomposition of the compounds in addition to the separation and recovery of gold and/or silver therefrom.

For this purpose, liquids containing Au-CN compounds are treated usually by the following two-step process: i.e., (a) zinc is added to such liquid whereby Au in the Au-CN compound is substituted with Zn to precipitate gold, followed by separation; and (b) the zinc cyanide formed through the above substitution is then decomposed with sodium hypochlorite. By such process, gold is usually collected in a recovery rate of about 70 to 80%.

The above conventional process has the following drawbacks:

(1) The recovery of gold and the decomposition of zinc cyanide are performed separately; this is inefficient.

(2) The substitution of Au with Zn needs to be conducted in a vacuum for avoiding the reduction of the efficiency in such substitution due to oxygen; the performance of the entire operation up to the separation of the gold precipitate from the reaction mixture in a vacuum is very cumbersome and requires an expensive apparatus.

(3) The Au concentration and the $CN^-$ concentration in the liquid are limited at most to several thousands of ppm, because the higher the Au concentration is, the lower the substitution efficiency tends to be, and the higher the $CN^-$ concentration is, the higher the concentration of zinc cyanide becomes in the liquid after the substitution, therefore the lower the decomposition efficiency of zinc cyanide by sodium hypochlorite tends to be. Liquids of higher Au or $CN^-$ concentrations need dilution for substitution or decomposition and therefore require a longer period of time for the treatment.

SUMMARY OF THE INVENTION

An object of the present invention is to provide a novel process for treating a liquid containing an Au-CN compound by decomposing the compound to reduce the $CN^-$ concentration in the liquid and, at the same time, to separate out the gold component singly.

Another object of the invention is to provide a novel process by which a liquid containing an Au-CN compound even in a high concentration can be treated through a simple procedure to fully decompose the compound and, at the same time, to separate gold from the liquid with ease and recover the same with a high recovery rate.

A further object of the invention is to provide a novel process for treating a liquid containing both an Au-CN compound and an Ag-CN compound, the process being capable of fully decomposing them by a simple procedure and, at the same time, separating gold and silver from the liquid with a high recovery rate.

When the liquid to be treated contains an Au-CN compound, these objects can be fulfilled by heating the liquid at a temperature of at least 170° C. in the presence of at least 0.1 mole of a water-soluble metallic hydroxide per gram atom of the gold in the Au-CN compound.

When the liquid to be treated contains both an Au-CN compound and an Ag-CN compound, the objects can be accomplished by heating the liquid at a temperature of at least 170° C. in the presence of a water-soluble metallic hydroxide in a total amount of at least 0.1 mole per gram atom of the gold in the Au-CN compound and at least 0.05 mole per gram atom of the silver in the Ag-CN compound.

BRIEF DESCRIPTION OF THE DRAWING

The drawing attached hereto is a diagram illustrating a typical embodiment of the system according to the invention.

DETAILED DESCRIPTION OF THE INVENTION

Figure 1:
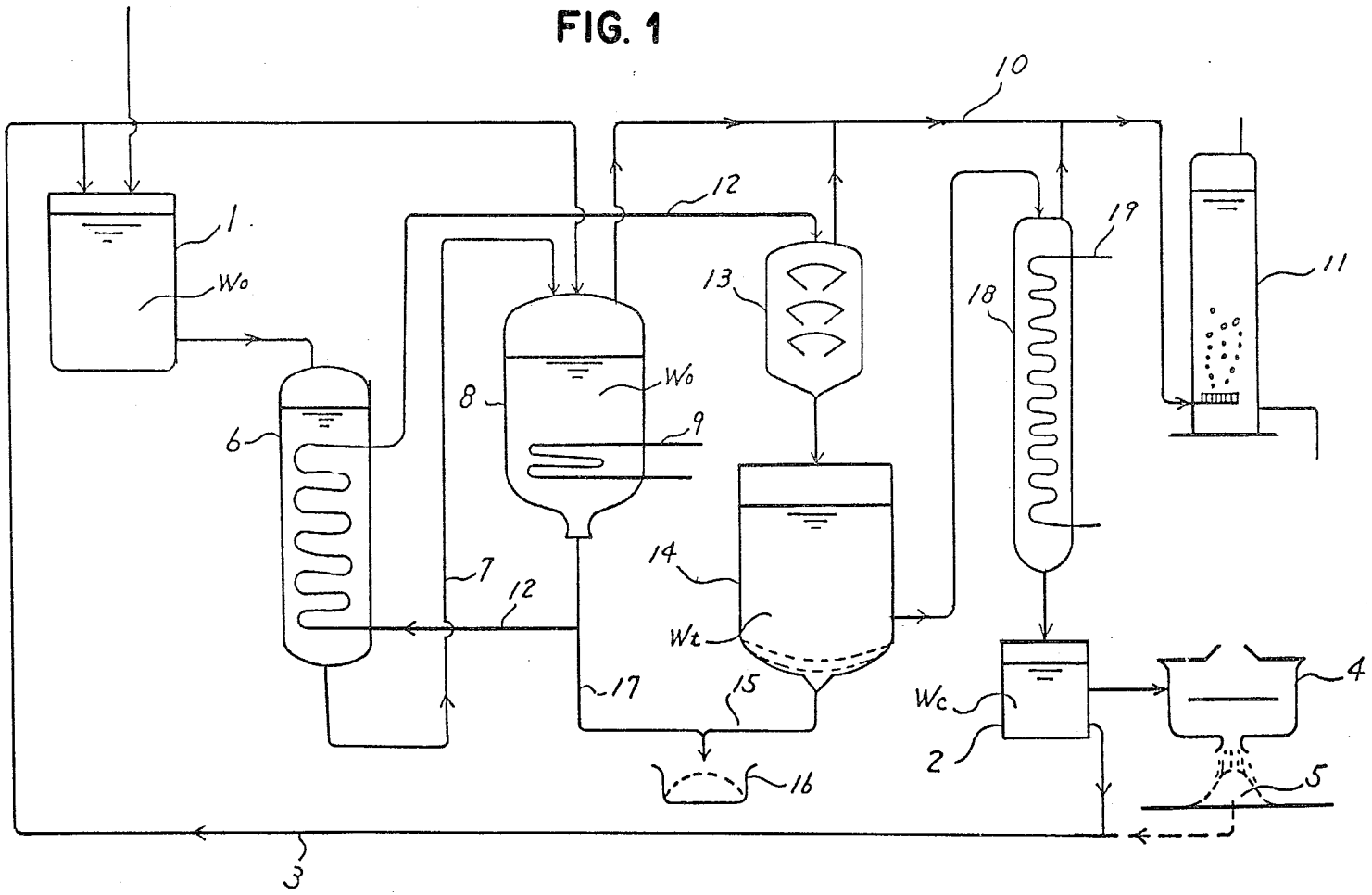

According to the invention, a variety of Au-CN compounds are treatable in the state of aqueous solution, or in the other state, such as dispersion, suspension, colloid and the like.

Examples of treatable Au-CN compounds are as follows:

(i) Dicyanoaurates represented by the formula (A):

$$M[Au(CN)_2]_n \quad (A)$$

wherein M is a cation having a valence of n, such as $Na[Au(CN)_2]$, $K[Au(CN)_2]$, $NH_4[Au(CN)_2]$, $Ba[Au(CN)_2]_2$, $Zn[Au(CN)_2]_2$, $Ni[Au(CN)_2]_2$, etc.

(ii) Halogenated dicyanoaurates represented by the formula (B):

$$M[Au(CN)_2X_2]_n \quad (B)$$

wherein M is a cation having a valence of n, and X is a halogen element, such as $K[Au(CN)_2I_2]$, $Na[Au(CN)_2Br_2]$, etc.

(iii) Tetracyanoaurates represented by the formula (C):

$$M[Au(CN)_4]_n \quad (C)$$

wherein M is a cation having a valence of n, such as $K[Au(CN)_4]$, $Na[Au(CN)_4]$, $NH_4[Au(CN)_4]$, $Ag[Au(CN)_4]$, $Co[Au(CN)_4]_2$, etc.

(iv) Organoaurocyanide complexes, such as diethylgold(III) cyanide, dicyanotetraethylethylenediamine digold(III), etc.

Each n in the formulae (A), (B) and (C) is 1 to 4, respectively.

A liquid which contains a water-insoluble Au-CN compound, such as AuCN (aurous cyanide), can also be treated.

In the present invention a liquid containing one kind or many kinds of Au-CN compounds can be treated.

Of these Au-CN compounds, advantageously treatable are the compounds of the formulae (A) and (C), among which more advantageously treatable are those in which M is an alkali metal or alkaline earth metal, especially Na or K.

Liquids containing an Au-CN compound and resulting from industrial processes include waste gold plating solutions comprising predominantly dicyanoaurates, such as $Na[Au(CN)_2]$, etc., aqueous alkali cyanide solutions dissolving gold from wastes or rejects of gold-plated products and aqueous solutions of alkali metal or alkaline earth metal cyanides dissolving gold-containing ores. These Au-CN compound containing liquids can be treated effectively by the process of the invention.

When the liquid to be treated contains water-soluble Au-CN compounds, it can be treated satisfactorily without dilution irrespective of whether the liquid is unsaturated, saturated or supersaturated with the compounds at a decomposition temperature as hereinafter stated. To assure a higher rate of decomposition and an improved recovery, however, it is preferable that the liquid be adjusted, before treatment, to a $CN^-$ concentration of at least 100 ppm, more preferably at least 1,000 ppm.

Industrial effluents containing Au-CN compounds often contain Ag-CN compounds also, so that it is desired to recover both gold and silver from the effluents simultaneously with the decomposition of those compounds. The process of this invention is useful also for the treatment of such effluents.

Various Ag-CN compounds are decomposable along with the Au-CN compound. Examples are:

(v) Dicyanoargentates represented by the formula (D):

$$M[Ag(CN)_2]_n \qquad (D)$$

wherein M is a cation having a valence of n and n is 1 to 4, such as $Na[Ag(CN)_2]$, $K[Ag(CN)_2]$, $Li[Ag(CN)_2]$, $Tl[Ag(CN)_2]$, $K_3Na[Ag(CN)_2]_4$, $Mg[Ag(CN)_2]_2$, $Zn[Ag(CN)_2]_2$, etc.

A liquid which contains water-insoluble Ag-CN compound, such as AgCN (silver cyanide), is also treatable.

In the present invention, a liquid containing one or many kinds of Ag-CN compounds can be treated along with one or many kinds of Au-CN compounds.

Liquids resulting from industrial processes and containing both an Au-CN compound and an Ag-CN compound include waste gold-silver alloy plating liquids containing dicyanoaurates, such as $Na[Au(CN)_2]$, $K[Au(CN)_2]$, etc., and dicyanoargentates, such as $Na[Ag(CN)_2]$, $K[Ag(CN)_2]$, etc., aqueous alkali cyanide solutions dissolving gold and silver wastes or rejects of articles plated with gold-silver alloy, and aqueous solutions of alkali metal or alkaline earth metal cyanides dissolving gold and silver-containing ores. These liquids can be treated effectively by the process of the invention.

Examples of water-soluble metallic hydroxides useful for the process of this invention are hydroxides of alkali metals, such as LiOH, NaOH, KOH, etc., and hydroxides of alkaline earth metals, such as $Ba(OH)_2$, $Ca(OH)_2$, $Sr(OH)_2$, etc. In this invention, one or more water-soluble metallic hydroxides can be employed. Alkali metal hydroxides, especially, NaOH and KOH, are preferable. The treatment of the invention is conducted in the presence of such water-soluble metallic hydroxide based on the finding that the use of the hydroxide is extremely effective in decomposing the compounds in the liquid and also in separating out gold, or gold and silver from the liquid singly. The water-soluble metallic hydroxide is used in an amount of at least 0.1 mole, preferably at least about 0.5 mole, per gram atom of the gold in the Au-CN compound contained in the liquid to be treated. When it is desired to treat the liquid containing both an Au-CN compound and an Ag-CN compound and to recover both gold and silver, at least 0.05 mole, preferably at least 0.3 mole, of the water-soluble metallic hydroxide is used per gram atom of the silver in the Ag-CN compound, in addition to the amount specified above for the Au-CN compound. The upper limit of the water-soluble metallic hydroxide is chosen from the viewpoint of economy and is thus, preferably about 10 moles per gram atom of the gold in the Au-CN compound or of the sum of the gold in the Au-CN compound and the silver in the Ag-CN compound. In this invention, the hydroxide may be wholly added, in the form of a solid or an aqueous solution, to the liquid before the treatment, or the hydroxide may be added to the liquid in small portions with the progress of the treatment.

According to the invention, if the liquids to be treated are heated at a temperature below 170° C., the Au-CN compound or Au-CN compound and Ag-CN compound in the liquid will not be fully decomposed. To ensure full decomposition of the compounds and to recover gold, or both gold and silver with an improved efficiency, it is desirable to carry out the heat treatment at a temperature of at least 200° C., more preferably at least 220° C. Since a high-pressure reactor is usually used for the process, it is suitable to conduct the treatment at a temperature of up to about 300° C. in view of the strength of the reactor. The heat-treatment time is about 10 hours at 170° C. although somewhat variable with the kind of compounds. The treatment time can be shorter at higher temperatures. The liquid can be heated directly by a heater provided within the high-pressure reactor, for example, by a sheathed heater or a heater employing a heat-resistant heat medium, such as dibenzylbenzene or silicone oil. Alternatively, the reactor can be heated in its entirety from outside. It is also possible to blow high-pressure steam into the liquid in the reactor. The use of such steam singly or in combination with some other heating means is advantageous in effecting uniform treatment since the liquid can then be agitated by the blow of steam.

The treatment of this invention produces ammonia. For promoted decomposition of Au-CN compounds or Ag-CN compounds, it is therefore desirable to use a high-pressure reactor equipped with an exhaust valve and remove the resulting ammonia through the valve from time to time.

The gold, or gold and silver contained in the liquid are separated out singly as such by the heat treatment of this invention. The metals separated from the liquid are isolated by filtration, purified in the usual manner when so desired, and then recovered.

The water-soluble metallic hydroxide to be used for the treatment is used preferably in a large quantity (at least 0.5 mole per gram atom of gold and at least 0.3 mole per gram atom of silver) to achieve an improved decomposition efficiency. In this case, a considerable part of the hydroxide used remains in the liquid resulting from the treatment. The process of this invention can therefore be practiced with a closed system in which the remaining hydroxide is reused. With this system, the treated liquid is added, as it is or as suitably concentrated, to the fresh liquid to be treated, or is completely evaporated to dryness to recover the water-soluble metallic hydroxide in the form of a solid, which is then reused. Thus, the treated liquid is not discarded in any of these methods. Consequently some gold, or some gold and silver, even if remaining in the treated liquid unseparated despite the heat treatment, will be admixed with a fresh liquid for treatment. This makes it possible to recover gold, or gold and silver from the liquid substantially completely.

The drawing attached is a diagram showing a typical example of the modes of practicing the invention with use of the above closed system.

With reference to the drawing, a tank 1 contains the liquid Wo to be treated, and a container 2 contains a concentrate Wc prepared by concentrating the liquid resulting from the treatment of the liquid Wo. The concentrate Wc is passed through a pipe 3 into the tank 1 or a high-pressure reactor 8 to supply a water-soluble metallic hydroxide to the liquid Wo at a desired rate. In place of the concentrate Wc, a solid product (chiefly comprising the water-soluble metallic hydroxide) obtained by evaporating to dryness or burning the concentrate Wc in an oven 4 may be added to and dissolved in the liquid Wo in the tank 1.

The liquid Wo is preheated by a heat exchanger 6 and fed to the reactor 8 via a pipe 7. The reactor 8 is made of heat-resistant and alkali-resistant material, such as steel, stainless steel, titanium or metal sheet having a cladding of such metal. The liquid Wo is treated for a predetermined period of time by being heated to a specified temperature with a heater 9 installed within the reactor 8. The ammonia gas produced by the heat treatment is led to an absorber 11 through a pipe 10 when so desired.

The reaction mixture resulting from the heat treatment and containing gold, or gold and silver separated is passed through a tube 12 extending through the heat exchanger 6 and is introduced into a flash tank 13, in which the mixture is exposed to the atmospheric pressure and vaporized. The steam and ammonia gas consequently formed are led through the pipe 10 into the ammonia gas absorber 11. The residual mixture Wt with gold, or gold and silver dispersed therein is stored in a tank 14. When the mixture is allowed to stand in the tank 14, the gold, or gold and silver settle on the bottom. The metal deposit is drawn off from the tank 14 via a pipe 15 and received in a receptacle 16. When the heat treatment gives a large amount of gold, or gold and silver deposit within the reactor 8, the deposit is withdrawn therefrom through a pipe 17 and placed into the receptacle 16.

The supernatant liquid of the mixture Wt in the tank 14 is sent to an evaporator 18 maintained at a high temperature by a heater 19 and is concentrated. The concentrate Wc is contained in the container 2. The concentrate Wc, which contains the water-soluble metallic hydroxide, is admixed with a fresh liquid Wo.

Since the liquid Wo produced by an industrial process generally contains organic compounds, the liquid turns black when treated by the process of the invention. Furthermore, the repeated use of the concentrate Wc gives an increased degree of blackness to the concentrate and increases the amount of black muddy product. In such a case, the concentrate Wc is transferred to the oven 4, where it is evaporated to dryness or, preferably, burned to remove water and organic compounds and afford a solid product 5 comprising chiefly the water-soluble metallic hydroxide and suitable for reuse. Gold, or gold and silver, even if remaining in the concentrate Wc in the form of undecomposed form, will not be removed by the evaporation or burning but remain in the solid product and then admixed with the liquid Wo for treatment and recovery.

This invention will be described in greater detail with reference to the following examples and comparison examples, wherein the determination of the $CN^-$ concentration and of the gold and silver recovery rates was made in the following manner:

Determination of $CN^-$ concentration:

The determination was made according to the method as described in JIS (Japanese Industrial Standard) K 0102 (1974), 29.1.2 and 29.2.

Determination of gold recovery rate:

Gold recovery rate was calculated by the following equation:

$$\text{Gold recovery rate (\%)} = \frac{C_0 \cdot V_0 - C_1 \cdot V_1}{C_0 \cdot V_0} \times 100$$

in which:

$C_0$: gold concentration (mg/liter) of the specimen liquid before treatment $C_1$: gold concentration (mg/liter) of the treated liquid $V_0$: quantity (liter) of the specimen liquid before treatment $V_1$: quantity (liter) of the treated liquid The gold concentrations ($C_0$, $C_1$) of the specimen liquids were determined as follows:

Nitric acid (1+1) was added to a specimen liquid in a draft, and the mixture was heated for decomposition. With addition of sulfuric acid (1+1), the resulting mixture was heated strongly to white fumes for 30 minutes. After allowing the mixture to cool, nitric acid (1+1) was added thereto to dissolve the precipitates other than the gold. The residual precipitate (pure gold) was then separated off, and the amount was determined by chelatometric titration or atomic absorption spectrochemical analysis in the aqua regia solution of gold.

Determination of silver recovery rate:

Silver recovery rate was calculated by the following equation:

$$\text{Silver recovery rate (\%)} = \frac{C_0 \cdot V_0 - C_1 \cdot V_1}{C_0 \cdot V_0} \times 100$$

in which:

$C_0$: silver concentration (mg/liter) of the specimen liquid before treatment $C_1$: silver concentration (mg/liter) of the treated liquid $V_0$: quantity (liter) of the specimen liquid before treatment $V_1$: quantity (liter) of the treated liquid The silver concentrations ($C_0$, $C_1$) of the specimen liquids were determined as follows:

Nitric acid (1+1) was added to a specimen liquid in a draft, and the mixture was heated for decomposition. With addition of sulfuric acid (1+1), the resulting mixture was heated strongly to white fumes for 30 minutes. After allowing the mixture to cool, nitric acid (1+1)

was added thereto to dissolve the precipitate of silver as its nitrate. After diluting the resulting liquid, the silver concentration of the liquid was accurately determined by atomic absorption spectrochemical analysis.

EXAMPLE 1

Three grams of NaOH and 20 g of $K[Au(CN)_2]$ were dissolved in 2 liters of water to prepare an aqueous solution ($CN^-$ concentration: 1,800 ppm), which was then placed into a 6-liter container made of stainless steel and resistant to pressure and to alkalis. With the container closed, the solution was heated at 230° C. for 6 hours by an electric heater. The solution thus treated was found to have a $CN^-$ concentration of 0.1 ppm. The treatment produced a gold deposit on the bottom of the container and the gold recovery rate was 99.9%.

EXAMPLES 2 TO 9 AND COMPARISON EXAMPLES 1 TO 3

A waste gold plating liquid containing dicyanoaurates as the main components was treated in the same manner as in Example 1 under the conditions and with use of the alkali hydroxide listed in Table 1. Table 1 also shows the kind of ions dissolved and their concentrations in the liquid before treatment, the gold recovery rate achieved and the residual $CN^-$ concentration of the liquid after treatment.

TABLE 1

| | Components in liquid before treatment (g/l) | | | | Alkali hydroxide (g/l) | | Treatment | | Gold recovery rate (%) | $CN^-$ concentration after treatment (ppm) |
|---|---|---|---|---|---|---|---|---|---|---|
| | Au | Na | K | CN | NaOH | KOH | Temp. (°C.) | Time (hr) | | |
| Example 2 | 3.5 | 2.7 | — | 3.0 | 10 | — | 170 | 6 | 90.0 | 120.0 |
| 3 | 6.0 | — | 7.8 | 5.2 | 10 | — | 175 | 6 | 91.2 | 140.0 |
| 4 | 9.4 | — | 15.0 | 10.0 | 10 | — | 200 | 6 | 97.2 | 56.0 |
| 5 | 9.4 | 11.0 | — | 12.0 | 10 | — | 210 | 6 | 99.7 | 7.4 |
| 6 | 9.4 | — | 15.0 | 10.0 | 10 | — | 230 | 6 | 99.9 | 0.1 |
| 7 | 6.0 | 4.7 | — | 5.3 | 0.4 | — | 230 | 6 | 91.4 | 210.0 |
| 8 | 6.0 | 4.7 | — | 5.3 | 0.6 | — | 230 | 6 | 98.5 | 25.0 |
| 9 | 6.0 | — | 7.8 | 5.2 | — | 1.0 | 230 | 6 | 99.5 | 8.4 |
| Comparison Example 1 | 6.0 | 4.7 | — | 5.3 | 10 | — | 150 | 6 | 8.0 | 1800.0 |
| 2 | 6.0 | — | 7.8 | 5.2 | 10 | — | 165 | 6 | 52.0 | 770.0 |
| 3 | 6.0 | 4.7 | — | 5.3 | — | — | 230 | 6 | 29.0 | 1200.0 |

EXAMPLES 10 TO 12 AND COMPARISON EXAMPLES 4 AND 5

A waste gold plating liquid ($CN^-$ concentration: 1,600 ppm) having the composition listed in Table 2 and comprising tetracyanoaurates as the main components was treated in the same manner as in Example 1 under the conditions and with use of the alkali hydroxide listed in Table 2. Table 2 also shows the gold recovery rate achieved and the residual $CN^-$ concentration of the liquid after treatment.

TABLE 2

| | Components in liquid before treatment (g/l) $KAu(CN)_4 \cdot 2H_2O$ | Alkali hydroxide (g/l) NaOH | Treatment Temp. (°C.) | Time (hr) | Gold recovery rate (%) | $CN^-$ concentration after treatment (ppm) |
|---|---|---|---|---|---|---|
| Example 10 | 10 | 10 | 170 | 6 | 93.0 | 104.0 |
| 11 | 10 | 10 | 200 | 6 | 98.3 | 27.0 |
| 12 | 10 | 10 | 230 | 6 | 99.9 | 0.1 |
| Comparison Example 4 | 10 | 10 | 160 | 6 | 55.0 | 680.0 |
| 5 | 10 | 0 | 230 | 6 | 72.0 | 410.0 |

EXAMPLE 13 AND COMPARISON EXAMPLE 6

The liquid containing water-insoluble AuCN (aurous cyanide) (AuCN content: 5 g/l; $CN^-$ concentration: 0.58 g/l) was treated in the same manner as in Example 1 under the conditions and with use of the alkali hydroxide listed in Table 3. Table 3 also shows the gold recovery rate achieved and the residual $CN^-$ concentration of the liquid after treatment.

TABLE 3

| | Components of liquid before treatment (g/l) AuCN | Alkali hydroxide (g/l) NaOH | Treatment Temp. (°C.) | Time (hr) | Gold recovery rate (%) | $CN^-$ concentration after treatment (ppm) In liquid | In Deposit |
|---|---|---|---|---|---|---|---|
| Example 13 | 5 | 5 | 230 | 6 | 99.9 | <0.02 | <10 |
| Comparison Example 6 | 5 | 0 | 230 | 6 | 78.0 | 143 | 880 |

EXAMPLES 14 TO 20

A gold-silver plating liquid containing $Na[Au(CN)_2]$ and $Na[Ag(CN)_2]$ as the main components was treated in the same manner as in Example 1 under the conditions and with use of the amount of NaOH listed in Table 4. Table 4 also shows the kind of ions dissolved and their concentrations in the liquid before treatment, the gold and silver recovery rates and the residual $CN^-$ concentration of the liquid after treatment.

TABLE 4

| Example No. | Components in liquid before treatment (g/l) Au | Ag | Na | CN | Alkali hydroxide (g/l) NaOH | Treatment Temp. (°C.) | Time (hr) | Gold recovery rate (%) Gold | Silver | $CN^-$ concentration after treatment (ppm) |
|---|---|---|---|---|---|---|---|---|---|---|
| 14 | 3.0 | 3.0 | 4.5 | 5.1 | 10 | 170 | 6 | 90.2 | 93.2 | 230.0 |
| 15 | 3.0 | 3.0 | 4.5 | 5.1 | 10 | 175 | 6 | 91.3 | 96.6 | 100.0 |
| 16 | 3.0 | 3.0 | 4.5 | 5.1 | 10 | 200 | 6 | 99.1 | 99.3 | 7.7 |
| 17 | 3.0 | 3.0 | 4.5 | 5.1 | 10 | 210 | 6 | 99.7 | 99.9 | 3.9 |
| 18 | 3.0 | 3.0 | 4.5 | 5.1 | 10 | 230 | 6 | 99.9 | 99.9 | 0.1 |
| 19 | 3.0 | 3.0 | 4.5 | 5.1 | 1.0 | 230 | 6 | 99.6 | 99.7 | 6.5 |
| 20 | 3.0 | 3.0 | 4.5 | 5.1 | 0.4 | 230 | 6 | 91.6 | 97.2 | 94.0 |

EXAMPLE 21

Two liters of the liquid treated in Example 7 was concentrated to 1 liter by heating after filtering off the gold deposited therefrom. The whole quantity of the concentrate was added to a fresh portion (2 liters) of the same waste gold plating liquid as used in Example 7, and the waste liquid was heat-treated in the same manner as in Example 7. Subsequently 3 liters of the treated liquid were concentrated to 1 liter after filtering off the resulting gold deposit, and the concentrate was used for the treatment of a fresh portion (2 liters) of the same waste liquid as used above. In this way, the waste liquid was treated five times, using the treated waste liquid repeatedly five times. The liquid obtained by the treatment each time was found to have a residual $CN^-$ concentration of up to 220 ppm, and the overall gold recovery rate was 98.5%.

What is claimed is:

1. A process for treating a liquid containing an Au-CN compound characterized in that the liquid is heated at a temperature of at least 170° C. in the presence of at least 0.1 mole of a water-soluble metallic hydroxide per gram atom of the gold in the Au-CN compound to recover gold.

2. The process according to claim 1, wherein the liquid contains additionally an Ag-CN compound and the heating is effected in the presence of an additional amount of at least 0.05 mole per gram atom of the silver in the Ag-CN compound to recover gold and silver.

3. The process according to claim 1 or 2, wherein the Au-CN compound is at least one compound selected from the group consisting of (i) dicyanoaurates represented by the formula: $M[Au(CN)_2]_n$ wherein M is a cation having a valence of n and n is 1 to 4, (ii) halogenated dicyanoaurates represented by the formula: $M[Au(CN)_2X_2]_n$ wherein M is a cation having a valence of n, n is 1 to 4 and X is a halogen element, (iii) tetracyanoaurates represented by the formula: $M[Au(CN)_4]_n$ wherein M is a cation having a valence of n and n is 1 to 4, and (iv) auroorganocyanide complexes.

4. The process according to claim 2, wherein the Ag-CN compound is a dicyanoargentate represented by the formula: $M[Ag(CN)_2]_n$ wherein M is a cation having a valence of n and n is 1 to 4.

5. The process according to claim 1 or 2, wherein the water-soluble metallic hydroxide is at least one compound selected from the group consisting of LiOH, NaOH, KOH, $Ba(OH)_2$, $Ca(OH)_2$ and $Sr(OH)_2$.

6. The process according to claim 1 or 2, wherein the water-soluble metallic hydroxide remaining in the liquid treated by the process of claim 1 or 2 is reused as at least a part of the water-soluble metallic hydroxide.

* * * * *